United States Patent [19]

Henderson

[11] 4,389,198

[45] Jun. 21, 1983

[54] OUTBOARD MOTOR SYSTEM

[75] Inventor: Ronald C. Henderson, Cohasset, Mass.

[73] Assignee: Harbormaster, Division of Mathewson Corp., Quincy, Mass.

[21] Appl. No.: 186,904

[22] Filed: Sep. 15, 1980

[51] Int. Cl.[3] ..... B63H 5/12

[52] U.S. Cl. ..... 440/60; 440/61

[58] Field of Search ..... 440/49-66, 440/75, 4

[56] References Cited

U.S. PATENT DOCUMENTS

| | | | |
|---|---|---|---|
| 2,902,967 | 9/1959 | Wanzer | 440/58 |
| 3,396,692 | 8/1968 | Bergstedt | 440/62 |
| 3,404,656 | 10/1968 | Chamberlain | 440/64 |
| 3,556,040 | 1/1971 | Strang | 440/75 |
| 3,570,443 | 3/1971 | Dewhurst | 440/61 |
| 3,583,357 | 6/1971 | Shimanckas | 440/62 |

FOREIGN PATENT DOCUMENTS

| | | | |
|---|---|---|---|
| 1901456 | 8/1970 | Fed. Rep. of Germany | 440/4 |

*Primary Examiner*—Trygve M. Blix
*Assistant Examiner*—Jesús D. Sotelo
*Attorney, Agent, or Firm*—Robert T. Gammons

[57] ABSTRACT

An outboard motor system for propelling a vessel comprising a power plant stationarily fixed to the vessel with its drive shaft in the horizontal athwartship position, a propeller assembly comprising a propeller and a kinematic train for driving the same mounted to the vessel for rotation about a horizontal axis parallel to the axis of the drive shaft and for vertical movement relative to the drive shaft, the kinematic train including an input shaft, the axis of which coincides with the axis of rotation of the propeller assembly and is parallel to the drive shaft, pulleys fixed to the respective shafts and a band entrained about the pulleys.

4 Claims, 4 Drawing Figures

OUTBOARD MOTOR SYSTEM

BACKGROUND OF INVENTION

Outboard propeller mechanisms for vessels such as barges, scows and the like are old in the art and as illustrated, for example, in U.S. Pat. Nos. 2,335,597; 2,458,813; and 2,902,967. In these patents, a power plant is mounted in a stationary position on the vessel with its drive shaft parallel to the longitudinal axis of the vessel, and the propeller assembly is mounted so as to be rotatable about a horizontal axis athwartship of the vessel to enable disposing the propeller in a perpendicular position extending downwardly into the water and while in position to rotate the propeller about a vertical axis for the purpose of steering and also to enable swinging the entire propeller assembly upwardly to withdraw it from the water. The driving connection for the power plant to the outboard propeller assembly, because of the right angular relation of the drive shaft to the input shaft, imposes limitations on the drive angles, limits the input horsepower and speed, occupies more space than is desirable, transmits shock loads and generally is a source of constant trouble. It is the purpose of this invention to simplify the drive between the power plant and the outboard propeller assembly in such a way as to enable economizing in space requirements and to enable complete freedom of movement of the propeller assembly without interfering with the continuity of drive between the power plant and the propeller assembly.

SUMMARY OF INVENTION

As herein illustrated, the invention comprises an outboard motor system for propelling a vessel comprising a power plant embodying a drive shaft, means stationarily mounting the power plant on the vessel with the drive shaft in a horizontal athwartship position, an outboard propeller assembly comprising a propeller and kinematic means for driving the same, means mounting the outboard propeller assembly on the vessel for angular movement about a second horizontal axis parallel to the axis of the drive shaft and for vertical movement relative to the drive shaft, said kinematic means including an input shaft rotatable about an axis coinciding with said second axis, rotation of which effects by way of said kinematic means rotation of the propeller and means drivably connecting the drive shaft to the input shaft which permits angular and vertical movement of the propeller assembly relative to the drive shaft without interrupting continuous drive from the drive shaft to the input shaft. The means for connecting the drive shaft to the input shaft comprise pulleys fixed to the respective shafts and a band entrained about said pulleys. Optionally, sprocket means may be employed and a chain entrained about the sprocket means. The propeller assembly which includes the propeller and kinematic means for driving the propeller is movable from a position in which the propeller is extending downwardly from the vessel into the water to an upstanding, rearwardly-inclined position above the vessel. The means for mounting the outboard propeller assembly comprise bearings mounted on the vessel and trunions fixed to the assembly rotatably engaged with the bearings. The means for effecting vertical movement relative to the vessel to enable raising and lowering the propeller assembly and, hence, the propeller relative to the bottom comprise pneumatic, hydraulic, electric or mechanical ratchet mechanisms. The kinematic means comprise, in addition to the input shaft, a transmission shaft journaled for rotation about an axis at right angles to the input shaft and a propeller shaft journaled for rotation at right angles to the transmission shaft to which the propeller is fixed and includes meshing pinion gears fixed, respectively, to the input and transmission shafts and meshing pinion gears fixed, respectively, to the transmission and propeller shafts. The propeller shaft and propeller attached thereto are rotatable about the axis of the transmission shaft. The propeller assembly comprises rotatably connected fixed and movable parts, the fixed part being rotatable about the input shaft, but constrained from rotation about the axis of the transmission shaft. The movable part is rotatable with the fixed part about the horizontal axis of the input shaft and rotatable about the axis of the transmission shaft relative to the fixed part. The axes of the input and transmission shafts lie in a common plane and the axes of the transmission and propeller shafts lie in a plane at right angles to the common plane in which the input and transmission shafts lie. The assembly includes an elongate gear box rotatably supported by the bearings at its opposite ends for rotation about said horizontal axis of the support shaft, bearings medially of its ends rotatably supporting the transmission shaft and bearings at the opposite ends for alternately rotatably receiving the input shaft to thus enable reversing the direction of rotation of the propeller.

The invention will now be described in greater detail with reference to the accompanying drawings, wherein.

Figure 1:
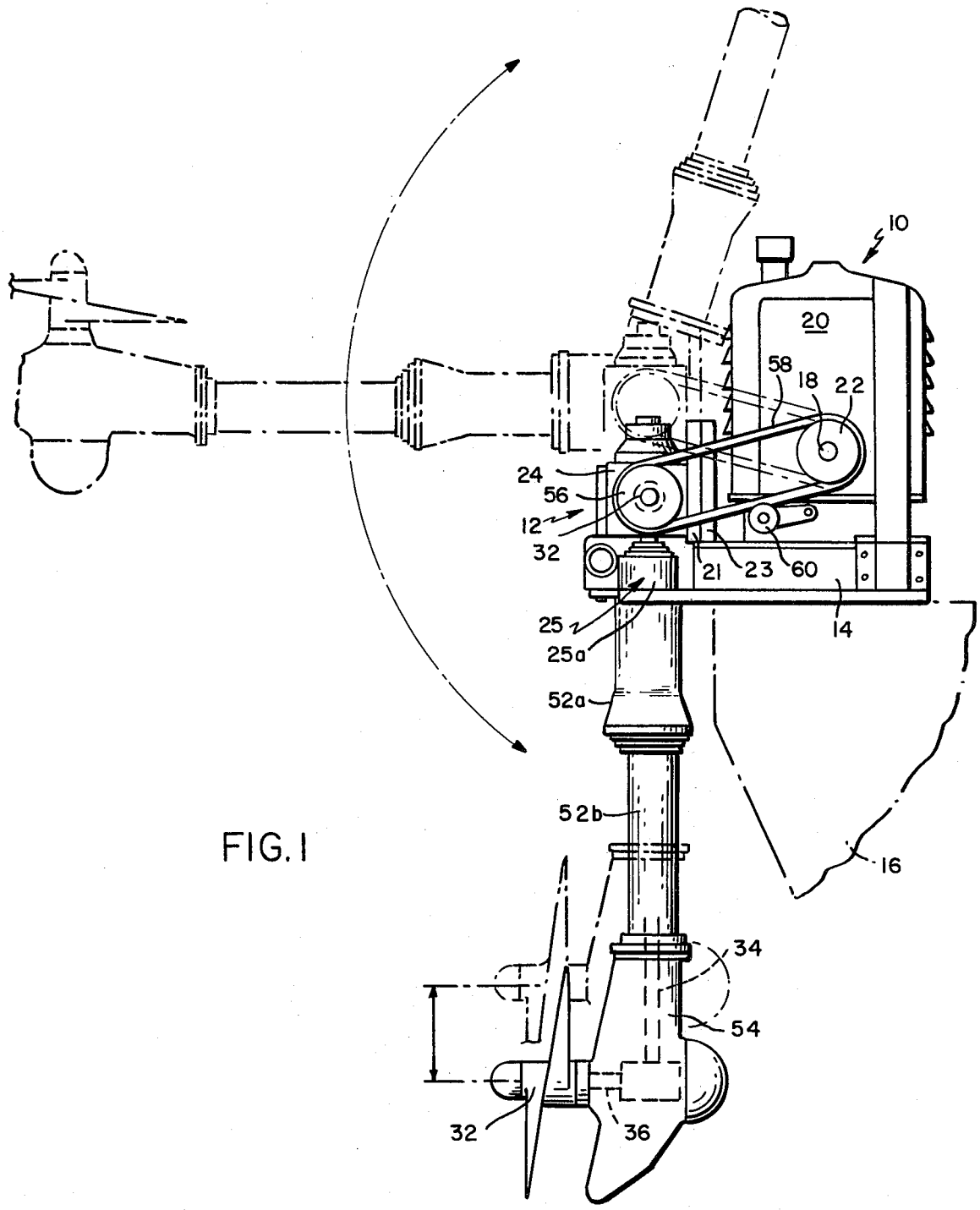
FIG. 1 is an elevation of the outboard motor system showing the power plant and outboard motor assembly with the latter shown in two positions of elevation relative to the bottom and in operable and inoperable positions.
Figure 2:
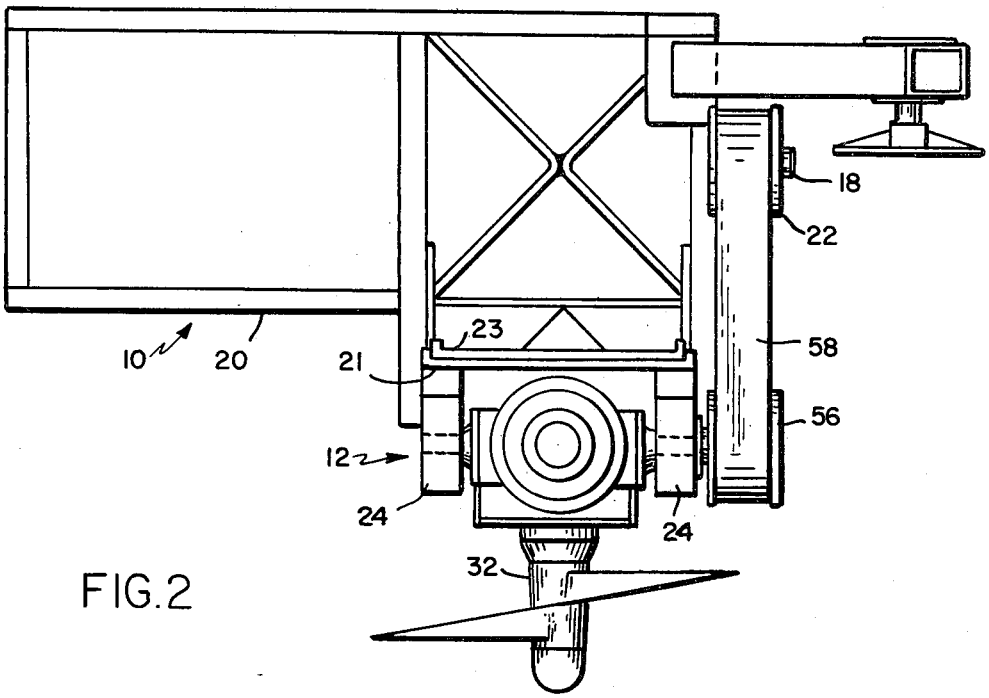
FIG. 2 is a plan view.
Figure 3:
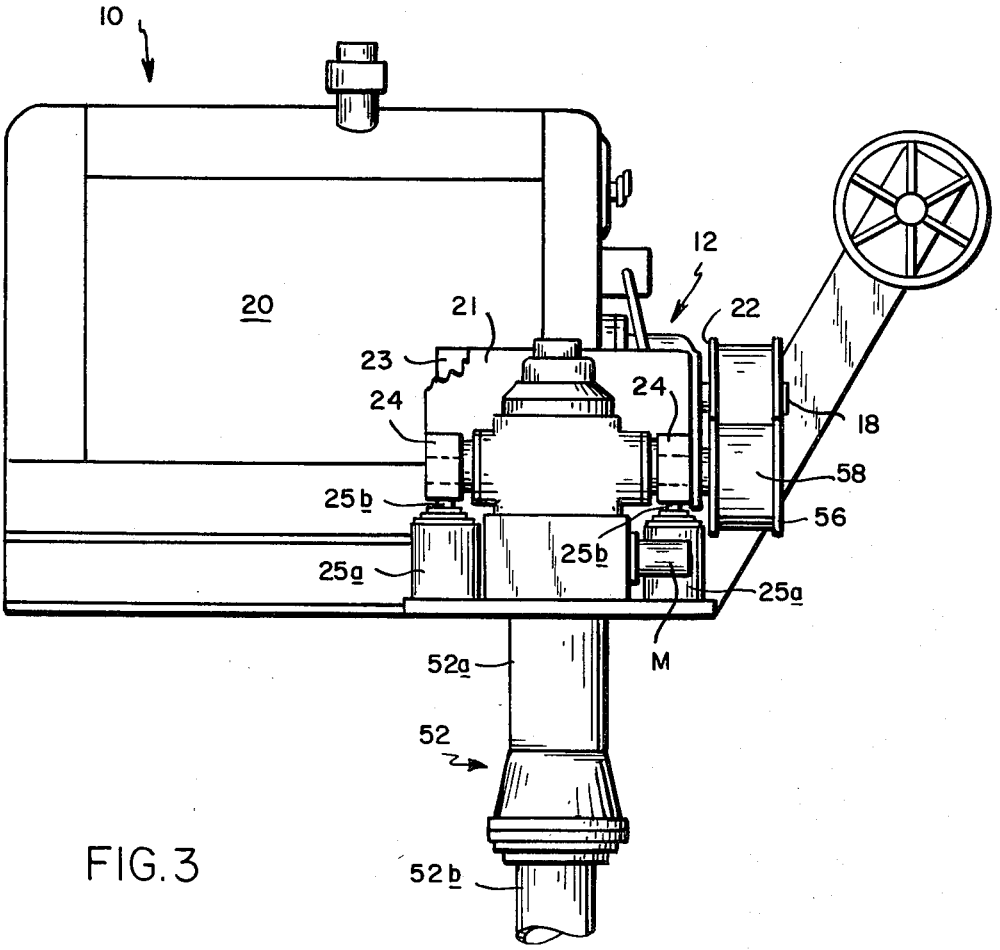
FIG. 3 is an elevation as seen abaft the stern of a vessel.

Referring to the drawings, FIGS. 1 to 3, the outboard motor system as herein illustrated comprises essentially a power plant 10 and an outboard motor assembly 12. The power plant is attached to a rigid base 14, FIG. 1, which, in turn, is attached to the deck of a vessel, a portion of which is shown at 16 in a position such that its drive shaft 18 is disposed athwartship of the vessel in a horizontal position. As thus mounted, the power plant occupies a minimal amount of space on the deck providing a substantial saving in space over such prior installations wherein the power plant has been positioned with its drive shaft fore and aft parallel to the longitudinal dimension of the vessel. As illustrated, the power plant comprises a suitable gasoline, diesel engine or other prime mover 20 which drives the shaft 18 and the latter is provided with a pulley 22.

Figure 4:
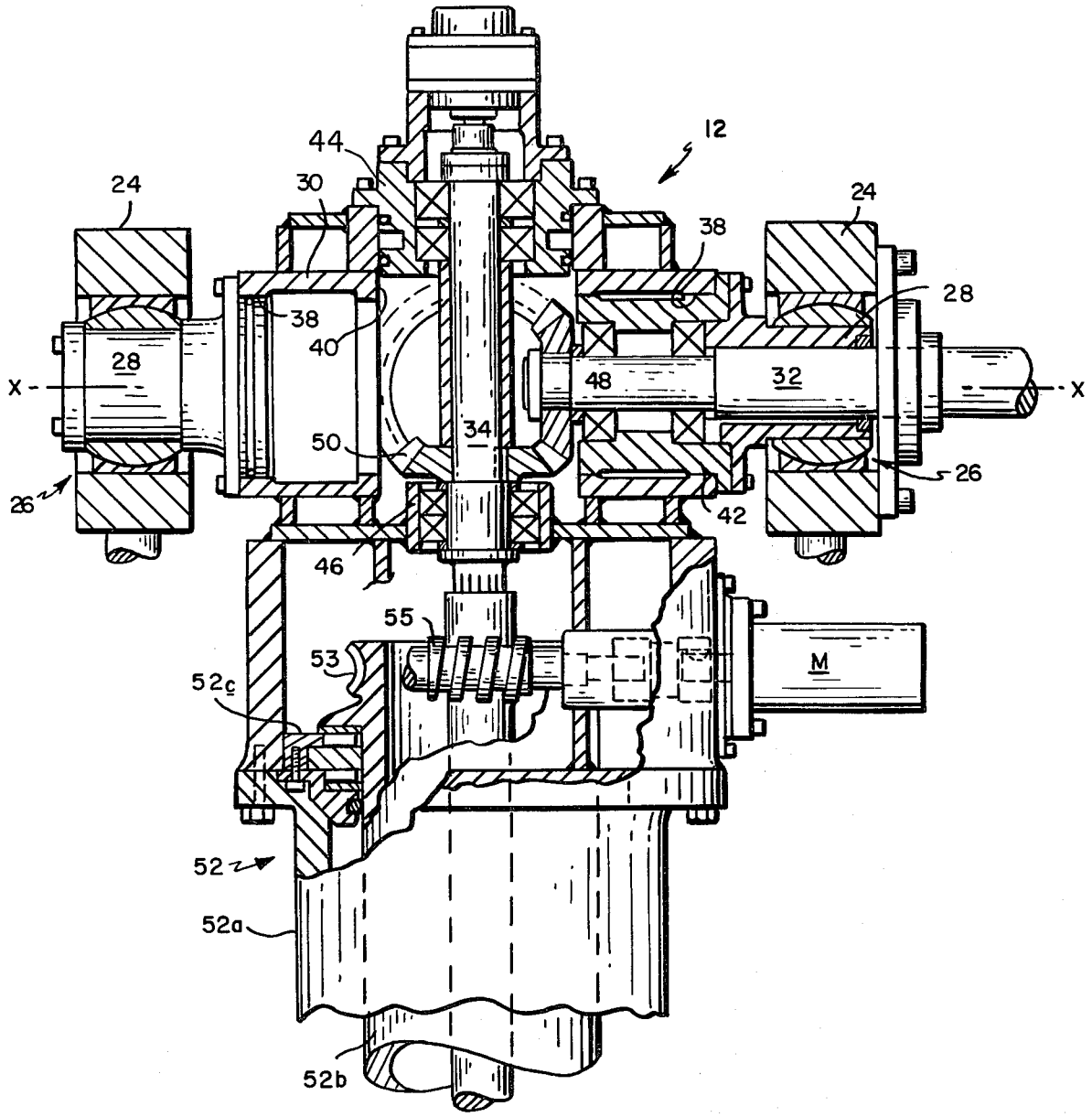
FIG. 4 is a view partly in elevation and partly in section of the outboard propeller assembly.

The propeller assembly 12, FIG. 4, is rotatably mounted for rotation in a vertical plane about a horizontal axis X—X spaced from and parallel to the axis of the drive shaft 18 by means of bearing blocks 24—24 containing bearing assemblies 26—26 for rotatably receiving trunions 28—28 secured to the opposite ends of a gear box 30 within which is journaled a kinematic train which is connected to the drive shaft 18 and provides the drive for a propeller 32 at the lower end of the assembly. The rotational movement of the propeller in the vertical plane permits the propeller assembly to be swung aft and upwardly out of the water. The extent of rotation of the propeller assembly is illustrated in FIG. 1 by the line b which, as shown, is in excess of 180° so that when the assembly is raised to an upright position, it will rest in this position without securing. The bearing blocks 24—24 are supported for vertical movement relative to the deck of the vessel on vertical, slidably-engaged channel members 21, 23, the bearing blocks being fixed to the channel 21 and the channel 23 being fixed to the frame 14. There are means 25—25 comprising hydraulic or pneumatic cylinders or mechanical ratchet mechanisms for effecting such vertical movement. As herein shown, the means 25—25 comprise hydraulic cylinders **25*a*—25*a* provided with pistons 25*b*—25*b***. The vertical movement enables raising and lowering the position of the propeller while in the water to clear submerged objects and/or to clear the bottom where the water is shallow.

The kinematic train for transmitting drive from the drive shaft 18 to the propeller 32 comprises an input shaft 32, a transmission shaft 34 which may be comprised of several connected sections, and a propeller shaft 36. These shafts are journaled in the gear box 30 with the axis of the input shaft 32 coinciding with the axis X—X of rotation of the gear box, the axis of the transmission shaft 34 at right angles to the axis of the input shaft 32, and with the axis of the propeller shaft 36 at right angles to the axis of the transmission shaft 34. The gear box contains end openings 38—38 and a medial opening 40 at right angles to the end openings. A bearing cage 42 is mounted in the end opening at the right side as shown in FIG. 4 for rotatably receiving the input shaft 32. The bearing cage 42 is removably mounted in the end opening for removal therefrom and transfer to the bearing opening at the opposite side. This enables changing the direction of rotation of the input shaft 32 and, hence, the direction of rotation of the propeller without requiring a change of direction of the drive shaft 18. Bearing cages 44 and 46 are provided at the upper and lower ends of the opening 40 for rotatably receiving the transmission shaft 34. The axes of the shafts 32 and 34 lie in a common plane and bevel gears 48 and 50 fastened, respectively, to the shafts 32 and 34 provide a driving connection between the shafts. A transmission shaft housing 52 is attached to the gear box comprising a downwardly-extending fixed part **52*a* bolted to the gear box and a downwardly-extending rotatable part 52*b* rotatably supported in the fixed part by a bearing assembly 52*c* for rotation about an axis coinciding with the axis of the transmission shaft 34. At the upper end of the rotatable part 52*b*, there is an annular gear 53. A worm gear 55 is supported in mesh with the annular gear 53, rotation of which will rotate the part 53*b* about the axis of the shaft 34. A reversible motor M connected to the worm gear provides for rotation thereof in reverse direction. At the lower end of the part 52*b* there is a propeller mounting 54 in which the propeller shaft 36 is rotatably mounted in conventional fashion and in which there are meshing gears which connect the lower end of the transmission shaft 34 to the propeller shaft 36 to provide for drive from the transmission shaft 34 to the propeller shaft 36. Rotation of the shaft housing 52*b* enables rotating the propeller about the axis of the transmission shaft 34** which, in turn, provides for steering the vessel.

For transmitting the drive from the drive shaft 18 to the input shaft 32, a pulley 56 is fixed to the input shaft 32 in alignment with the pulley 22 fixed to the drive shaft 18 and an endless belt 58 is entrained about the two pulleys. The belt 58 is desirably comprised of a somewhat elastic material which has sufficient tensile strength to transmit the drive from one shaft to the other, but will yield under shock sufficiently to reduce shock loads which may be imposed on the system by grounding or striking submerged objects. In other words, by taking advantage of the damping characteristics inherent in an elastic material, for example, rubber or rubber-like materials used for the belt construction, the magnitude of shock loads may be substantially reduced. A spring-biased idler 60 is held against the belt 58 to take up slack and this maintains a non-slip drive for all heightwise positions of the propeller assembly relative to the drive shaft 18.

The use of pulleys and a belt for transmitting the drive from the power plant to the propeller assembly has the further advantage of greater flexibility in matching a variety of input, horsepower and speed changes by simply changing the diameter of the input pulley, that is, the pulley 22. A further advantage of the damping capacities inherent in rubber or rubber-like materials provides for isolation of the torsional influence of the driver pulley 22.

As will be observed in FIG. 2, the belt drive permits the vertical movement of the propeller assembly for the purpose of clearing obstructions or raising the propeller with respect to the bottom for shallow depths without interfering with the continuity of drive between the driving pulley and the driven pulley 22 and 56, respectively.

By arranging the input shaft of the propeller assembly in the gear box so that its axis of rotation coincides with the axis of rotation of the trunions mounting the propeller assembly, a very simple and efficient drive is provided which eliminates right angle gear sets that are currently required to allow the outboard drive assembly to pivot about its mounting axis in the horizontal plane to clear submerged objects upon contact and further allows for vertical adjustment to control draft without concern for drive angle limitations imposed by shaft drive systems, and allows for greater flexibility in positioning the driver on different horizontal planes by eliminating drive shaft angle considerations and the angular limitations imposed by universal constant velocity joints and the like.

The belt drive greatly simplifies installation of the prime mover by eliminating concern for alignment of the drive shaft 18 and the input shaft 32 in the vertical axis.

It should be understood that the present disclosure is for the purpose of illustration only and includes all modifications or improvements which fall within the scope of the appended claims.

What is claimed is:

1. An outboard motor assembly comprising a power plant, an outboard propeller assembly including a propeller, a common support mounted to the stern of the vessel, means stationarily mounting the power plant on the common support with its drive shaft athwartship, a pulley fixed to the drive shaft, a first mounting plate fixed to the common support, a second mounting plate fixed to the propeller assembly, said mounting plates having interengaged tongue and groove means by means of which the propeller assembly can be moved vertically relative to the power plant and which enables dismounting the entire outboard propeller assembly from the vessel, a pair of spaced, parallel bearing blocks mounted to the second mounting plate, a pair of bearing members fixed to the outboard assembly rotatably received and retained in said bearing blocks, supporting the outboard assembly for rotation about a horizontal axis parallel to the axis of the drive shaft, at least one of said bearing blocks containing a bearing opening parallel to the axis of the drive shaft, an input shaft journaled in said bearing opening, a pulley fixed to the said input shaft and a belt entrained about said pulleys, said outboard propeller assembly including a first gear housing, a pair of bevel gears mounted in said gear housing, one of which is fixed to said input shaft for turning about a horizontal axis and the other of which is mounted in the gear housing in mesh with the one gear for rotation about a vertical axis, a transmission shaft journaled in the gear housing with its axis at right angles to the input shaft, said transmission shaft extending through said other gear and being keyed thereto, a transmission housing mounted to said first gear housing, a second gear housing attached to the lower end of the transmission housing, a propeller shaft journaled in said second gear housing for rotation about a horizontal axis, a pair of meshing gears in said second gear housing, one of which is fixed to the propeller shaft, said transmission shaft extending downwardly through the transmission housing and being keyed to the other of said meshing gears such that rotation of the transmission shaft is transmitted through said second gear housing to the propeller shaft, said transmission housing being rotatably mounted to the first gear housing to enable turning the propeller about the vertical axis of the transmission shaft, a worm wheel fixed to the transmission housing in concentric relation to the transmission shaft, a worm supported in mesh with the worm wheel, a motor connected to the worm shaft to effect rotation of the transmission housing about the axis of the transmission shaft to enable rotating the propeller for steering and pneumatic cylinders mounted on the common support beneath the bearing blocks operable to raise and lower the outboard assembly relative to the common support, said bearing members supporting the outboard assembly for rotation of the propeller assembly from a position in which the transmission shaft extends downwardly from the common support for normal operation through an angle exceeding 180° to a position extending upwardly from the common support and inboard of the axis of rotation of the input shaft to an at rest stable position.

2. An outboard motor assembly according to claim 1 wherein the axes of the input and transmission shafts lie in a common plane and the axes of the transmission and propeller shafts lie in a common plane at right angles to the common plane in which the input and transmission shafts lie.

3. An outboard motor assembly according to claim 1 wherein the position of the input shaft can be reversed with respect to the transmission shaft to enable effecting rotation of the propeller alternately in a right-hand or left-hand direction without reversing the power plant.

4. An outboard motor assembly according to claim 1 wherein both the bearing members contain bearing openings for alternately rotatably receiving the input shaft to thus enable reversing the driving connection between the input shaft and the transmission shaft.

* * * * *